United States Patent [19]

Popper, Jr.

[11] Patent Number: 4,666,120

[45] Date of Patent: May 19, 1987

[54] APPARATUS AND ARTICLE FOR PIVOTALLY CONNECTING A BINDER TO A SUPPORT SURFACE

[76] Inventor: Robert H. Popper, Jr., 99 Laurel Hill Rd., Mountain Lakes, N.J. 07046

[21] Appl. No.: 802,180

[22] Filed: Nov. 26, 1985

Related U.S. Application Data

[63] Continuation of Ser. No. 345,818, Feb. 4, 1982, abandoned.

[51] Int. Cl.[4] ..... A47B 97/04

[52] U.S. Cl. ..... 248/447; 402/76; 402/77; 281/45; 312/233

[58] Field of Search ..... 248/447, 447.1, 340; 281/45; 402/76–77; 312/233; 211/46, 123, 94

[56] References Cited

U.S. PATENT DOCUMENTS

| | | | |
|---|---|---|---|
| 562,988 | 6/1896 | Van Meter | 248/447 |
| 605,148 | 6/1898 | Sylvester | 211/94 |
| 1,911,799 | 5/1933 | Buchan | 248/447 |
| 2,147,625 | 2/1939 | Brothers | 211/94 |
| 2,812,067 | 11/1957 | Gussack | 211/46 |
| 3,044,210 | 7/1962 | Upton | 248/447 |
| 3,275,279 | 9/1966 | Caldwell | 312/233 |
| 3,913,995 | 10/1975 | Malcik | 211/46 |
| 3,918,672 | 11/1975 | Torn | 248/447 |
| 3,967,807 | 7/1976 | Claxton | 248/447 |
| 4,300,744 | 11/1981 | Popper, Jr. | 248/447 |
| 4,312,453 | 1/1982 | Barber | 211/46 |
| 4,323,290 | 4/1982 | Hickman | 248/447 |

FOREIGN PATENT DOCUMENTS

| | | | |
|---|---|---|---|
| 525234 | 8/1940 | United Kingdom | 248/447 |

*Primary Examiner*—J. Franklin Foss
*Assistant Examiner*—Robert A. Olson
*Attorney, Agent, or Firm*—Drucker & Sommers

[57] ABSTRACT

An apparatus for pivotally connecting a binder to a support surface, to enable the binder to be moved between stored and accessed positions relative to the support surface. The apparatus is adapted to protect a book enclosed in the binder in stored position. The apparatus includes a link, secured to the support surface, and a yoke, pivotally interconnected between the binder and link. The yoke is adapted to press hingedly-mounted opposed covers of the binder together, upon movement to the stored position, so as to firmly enclose the book mounted in the binder, to effectively protect such book from damage thereto when so stored. The yoke is further adapted to enable pivoted movement of the binder, limited to prevent overtravel, for efficient access to the book mounted in the binder.

8 Claims, 7 Drawing Figures

Fig. 1
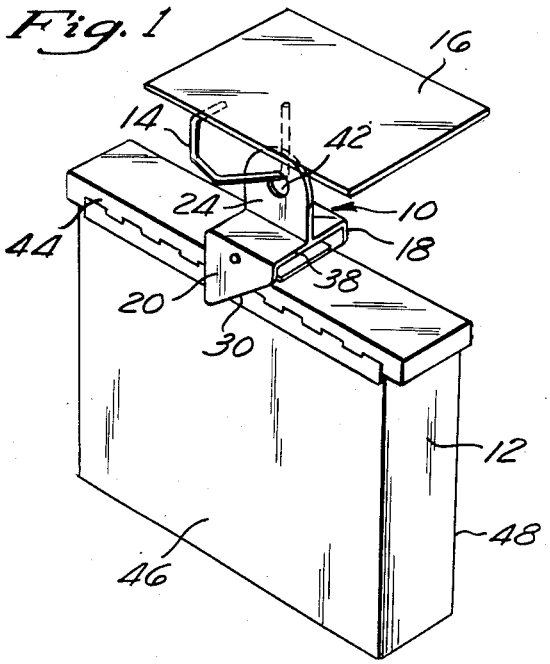
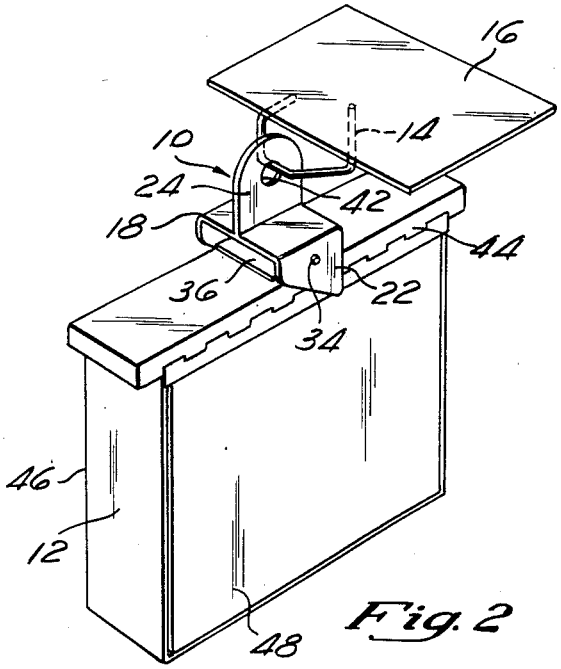
Fig. 2
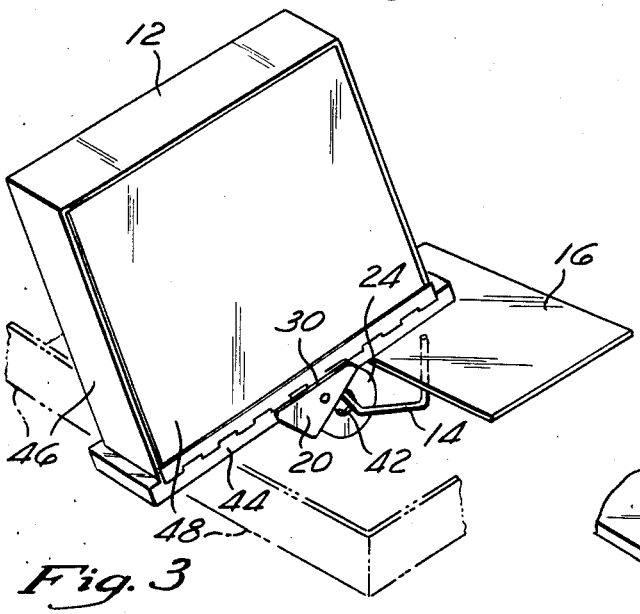
Fig. 3
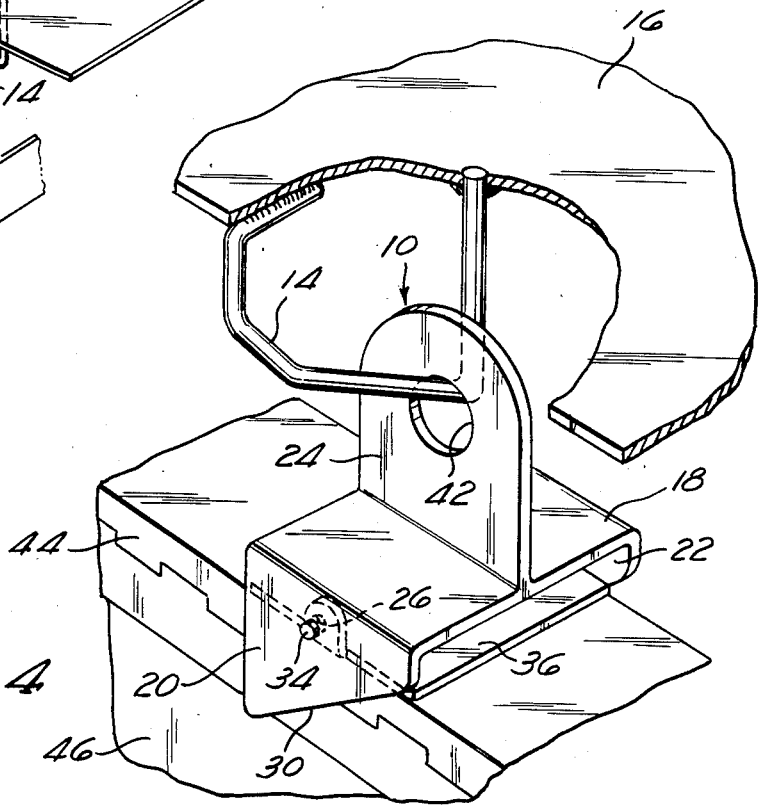
Fig. 4

Fig. 5
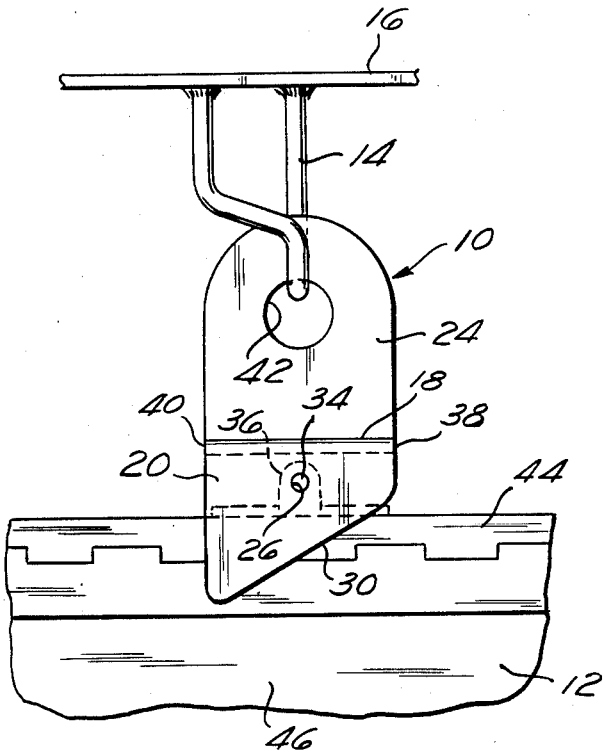
Fig. 6
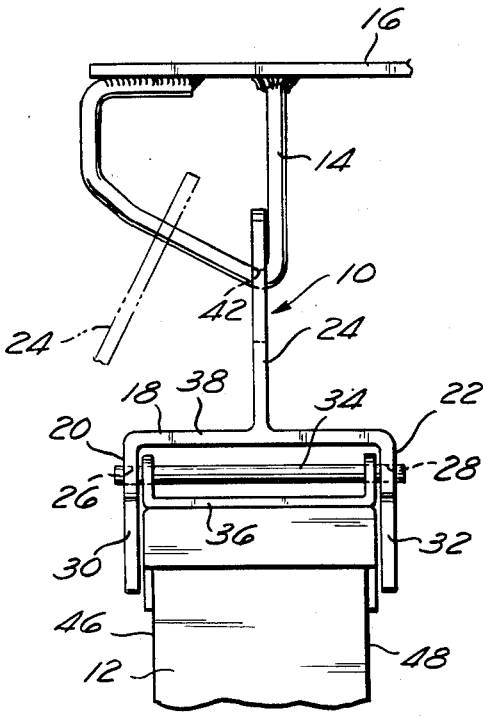
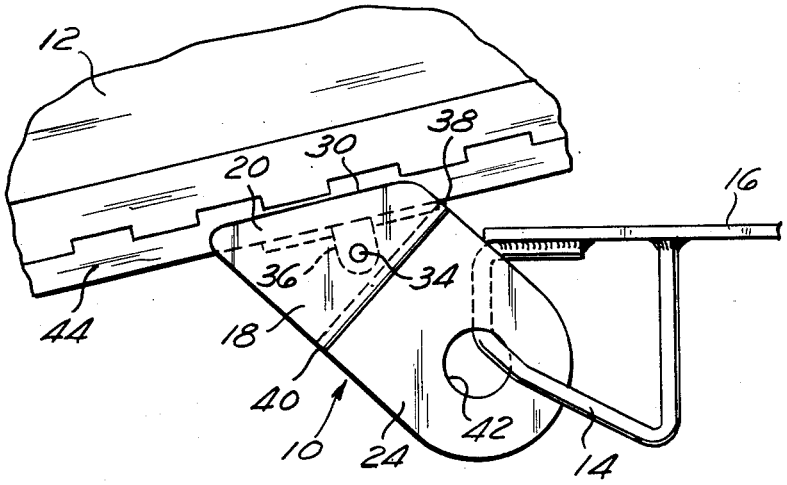
Fig. 7

APPARATUS AND ARTICLE FOR PIVOTALLY CONNECTING A BINDER TO A SUPPORT SURFACE

This application is a continuation of application Ser. No. 345,818, filed 2/4/82, now abandoned.

BACKGROUND OF THE INVENTION

1. Field of the Invention:

The invention relates generally to devices for connecting a binder to a support surface, and relates specifically to such a device adapted to pivotally connect the binder to the support surface, to prevent damage to a book, such as a telephone directory, mounted in the binder, and connected to a support shelf as in an outdoor exposed telephone stand.

2. Description of the Prior Art:

Applicant is not aware of prior art devices which, in the manner of the present invention, pivotally interconnect a binder to a support surface to enable convenient binder access, and press together the binder covers in the binder-stored position to prevent damages to a book enclosed therein. The closest prior art of which applicant is aware, applicant's U.S. Pat. Nos. 4,254,929 and 4,300,744, disclose devices which provide linked interengagement of a binder and a support surface.

SUMMARY OF THE INVENTION

The present invention is directed generally to a yoke, engageable with a binder, and a link, securable to a support surface, with which link the yoke is engageable.

The yoke is adapted to be pivoted and accessed along the link such that ready access to a book enclosable in the binder is provided. The yoke is further adapted to press the hinged covers of the binder together upon movement to stored position to securely protect the book enclosable in the binder.

The present invention is specifically directed to a link, attachable to a support surface, such as a shelf in an outdoor exposed telephone stand, and a yoke, interengageable with the link, pivotally connectable to a binder, as for enclosing a telephone directory. The link is preferably contoured such that the yoke and pivotally engaged binder are movable therealong between binder stored and accessed positions offset 90° from each other.

The yoke is shaped and dimensioned to enable pivotal movement of the yoke relative to the link and of the binder relative to the yoke, such movement preferably in the same plane, for convenient access to and storage of the binder. The yoke further preferably includes depending side portions having peripheral sloped edges, which press the binder covers together when the binder is in the stored position, to enclose and protect the book mounted in the binder, and which permit opening of the binder covers when the binder is in the accessed position, to enable access to and reading of the book.

Access to the binder and book mounted therein is provided by gripping the binder and moving same, as guided by the yoke and contoured link, limited by the yoke to prevent overtravel, to a position relative to the support surface where the binder covers and book can be opened, and the book can be conveniently read. The binder and book may then be stored by positioning and releasing same such that they execute a self-acting gravity drop to the stored position, guided by the yoke and link, and such that the yoke depending side portions press the binder covers together, to securely clamp same, and to prevent damage to the enclosed book from external sources such as the outdoor elements.

The yoke and interconnectable link of the present invention are readily, conveniently, and efficiently operable to provide readily accessible and securely storable positioning of a binder relative to a support surface, and to provide other advantages which will become apparent from the detailed description of the invention and the drawings herein.

BRIEF DESCRIPTION OF THE DRAWINGS

FIG. 1 is a front perspective view of a link secured to a support surface, and a yoke connected to a binder in stored position, in a preferred embodiment of the invention;

FIG. 2 is a similar view, with the binder in partly-accessed position;

FIG. 3 is a similar view with the binder in fully-accessed position;

FIG. 4 is a front perspective partly-fragmentary view of the apparatus in the binder-stored position;

FIG. 5 is a front elevational partly-fragmentary view of the apparatus in binder-stored position;

FIG. 6 is a side elevational partly-fragementary view of the apparatus in binder-stored position; and FIG. 7 is a side elevational partly-fragmentary view of the apparatus in the binder-accessed position.

DETAILED DESCRIPTION OF THE PREFERRED EMBODIMENT

Referring to FIGS. 1–7, the yoke 10 of the present invention is shown, pivotally connected to a binder 12, and to a link 14, secured to a support surface 16.

Yoke 10, as shown in the Figures, has a generally inverted-Y shape, and includes a body section 18, side sections 20 and 22 which depend from opposite sides of body section 18, parallel to each other, and a medial section 24 which extends generally upwardly from body section 18. Side sections 20 and 22 each include an opening 26 and 28, and peripheral edges 30 and 32 sloped in relation to body section 18. The side section openings 26 and 28 are aligned, and pivot pin 34 extends through such openings and a bracket 36, secured to binder 12, to pivotally connect binder 12 to yoke 10. Body section 18 includes opposed end edge 38, which prevents overtravel on access. Binder 12 moves pivotally and bears against yoke end edge 38, which limits pivotal movement of binder 12 relative to yoke 10. Sloped peripheral edges 30 and 32 of side sections 20 and 22 align with binder 12 when accessed, as shown in FIG. 3, permitting binder 12, and the book mounted therein, to be opened. Side sections 20 and 22 extend about and clamp binder 12 when stored, as shown in FIG. 2, tightly enclosing the book in binder 12. Medial section 24 of yoke 10 has an opening 42 therein, through which link 14 extends to pivotally connect yoke 10 to link 14.

Binder 12, as shown in the Figures, includes a spine 44, and a pair of opposite covers 46 and 48 hingedly connected to spine 44. Binder 12 forms a generally box-like receptacle when opposite covers 46 and 48 are closed, in which a book such as a telephone directory may be mounted and enclosed. When covers 46 and 48 are opened, access to the book is enabled. Pivot pin 34 connects binder 12 to yoke 10 through bracket 36 secured to binder 12.

Link 14 is generally U-shaped in one plane, as shown in FIG. 5, including curved and vertically-straight shaped parts, and is generally downwardly inclined in a second plane as shown in FIG. 6, which second plane is displaced 90° from the first plane. Such contours of link 14 are followed by yoke 10 in moving binder 12 between stored and accessed positions, enabling binder 12 to be stored generally parallel to the front of support surface 16, and accessed generally perpendicular to the front of support surface 16.

Support surface 16 may comprise, for example, a support shelf, extending outwardly from a telephone support post at a location beneath and adjacent the telephone support on such post, in a public outdoor exposed pay telephone stand. In such configuration, if an opening formed between covers 46 and 48, the book mounted in binder 12 would be exposed to the elements, which would subject the book to damage therefrom.

Referring to FIGS. 1–7, binder 12 is normally in the stored position shown in FIGS. 1 and 4, in which position yoke 10, binder 12, and the book mounted in binder 12 hang generally downwardly, and side sections 20 and 22 of yoke 10 bear against and press together binder covers 46 and 48, clamping same to prevent spaces from forming therebetween, for protecting the book mounted therein from damage caused by outside elements.

To obtain access to binder 12 and the book mounted therein, binder 12 is gripped by stored position as shown in FIG. 1, and pulled towards the user, as shown in FIG. 2 guided, through yoke 10, upwardly and outwardly relative to support surface 16 along the contours of the curved part of link 14, and displaced 90°, from a position parallel, to a position perpendicular, to the front of support surface 16, to the partly-accessed position shown in FIG. 2. To attain fully-accessed position, as shown in FIG. 3, yoke 10 is pivoted at opening 42 relative to and about link 14 and binder 12 is pivoted relative to yoke 10 about pivot pin 34, such pivoting movement being in the same plane, and limited by contact of binder spine 44 with yoke edge 38 and yoke 10 with support surface 16. In such accessed position, yoke sloped side section edges 30 and 32 are aligned with binder spine 44, enabling binder covers 46 and 48, and the book mounted in binder 12, to be opened for use, accessed in a convenient and efficient manner.

To return binder 12 and the book mounted therein to the normal stored position, binder 12 is released to move downwardly, as shown in FIG. 2, whereupon a self-acting gravity drop takes place, with binder 12 pivoting about and being guided by yoke 10, which yoke 10 in turn pivots about and is guided by link 14. Yoke side sections 20 and 22 pivot about pivot pin 34 and extend about covers 46 and 48 to clamp such covers together.

While the yoke, interengaged with the link, has been shown as a generally inverted-Y shaped article with sloped peripheral side section edges, and the link has been shown as having particular contours, the invention includes a yoke and link having different shapes which effect the results described above.

The present invention is of efficient, convenient, and effective design and construction, enabling secure enclosing of a book in a binder for protection of such book, while enabling ready, convenient, and rapid access to the book in the binder for use of such book. These and other advantages will be appreciated by those skilled in the art, from the present specification.

While a preferred embodiment of the present inventnion has been set forth in the above description for purposes of explanation of the invention, it is to be understood that variations and changes may be made in such embodiment which are nevertheless within the scope and spirit of the invention.

I claim:

1. A device for connecting a binder to a suppot surface, which binder is adapted to have a book mounted therein, which device is adapted to enable the binder to be movable through a multi-planar path to a position projecting towards the user for enabling opening of the binder covers and access to the book adapted to be mounted therein, further adapted to prevent overtravel of the binder upon access thereof, still further adapted to enable the binder to automatically return through the multi-planar path, upon release thereof from the accessed position, to a position recessed from and not projecting towards the user for storage of the binder, and still further adapted to automatically clamp the binder covers closed upon storage thereof, which device comprises:

(a) a connecting rod, adapted to be secured at the opposed ends thereof to the support for connection thereto, further adapted to guide movement of the binder through a multi-planar path between accessed position thereof, at which the binder projects towards the user for enabling opening of the binder covers and access to the book adapted to be mounted in the binder, and stored position thereof, at which the binder is recessed from and does not project towards the user for storing the binder and the book adapted to be mounted therein;

(b) a connecting yoke, including side portions and a medial portion, and further including a upstanding medial flange portion upstanding generally perpendicularly from the medial portion, adapted to enable guiding of the binder along the connecting rod, and pivoting of the yoke and binder relative to the support surface between stored and accessed positions, to enable opening of the binder covers and access to the book adapted to be mounted therein, upon pivoting of the binder to accessed position relative to the support surface, and further adapted to automatically clamp the binder covers closed upon pivoting of the binder to stored position relative to the support surface; and (c) means for pivotally connecting the connecting yoke to the binder.

2. A device as in claim 1, in which the support surface, to which the device is adapted to be connected, is adapted to project outwardly towards the user.

3. A device as in claim 1, in which the binder accessed and stored positions are offset 90 degrees from each other.

4. A device as in claim 1, in which the yoke upstanding flange portion has an opening therein through which the rod extends.

5. A device as in claim 1, in which the binder to which the device is adapted to be connected is adapted to include a spine, and in which the connecting yoke includes an end edge which is adapted to bear against the binder spine upon pivoted movement of the binder into accessed position in which the binder projects towards the user.

6. A device as in claim 1, in which the binder to which the device is adapted to be connected is adapted to include a spine, and a pair of covers hingedly mounted to the spine, and in which the connecting yoke depending side portion means includes a sloped edge, adapted to extend across and clamp the covers of the binder closed upon storage thereof, and to retract from extension across, and enable opening of, the covers of the binder upon access thereof.

7. A device as in claim 1, in which the yoke is generally inverted Y-shaped.

8. A device as in claim 2, in which the rod is adapted to be secured at both ends under the support surface.

* * * * *